US006086392A

United States Patent [19]

Okabe

[11] Patent Number: 6,086,392

[45] Date of Patent: Jul. 11, 2000

[54] LEVER FITTING TYPE CONNECTOR WITH TEMPORARY SET POSITION

[75] Inventor: Toshiaki Okabe, Shizuoka, Japan

[73] Assignee: Yazaki Corporation, Tokyo, Japan

[21] Appl. No.: 09/112,060

[22] Filed: Jul. 9, 1998

[30] Foreign Application Priority Data

Jul. 9, 1997 [JP] Japan ..... 9-184068

[51] Int. Cl.[7] ..... H01R 13/62

[52] U.S. Cl. ..... 439/157; 439/266

[58] Field of Search ..... 439/372, 157, 439/153, 266

[56] References Cited

U.S. PATENT DOCUMENTS

| | | | |
|---|---|---|---|
| 3,488,622 | 1/1970 | Gley | 439/157 |
| 4,586,766 | 5/1986 | Hofmeister | 439/160 |
| 4,981,440 | 1/1991 | Werner et al. | 439/266 |
| 5,441,420 | 8/1995 | Okumura et al. | 439/157 |
| 5,711,682 | 1/1998 | Maejima | 439/157 |
| 5,873,745 | 2/1999 | Duclos et al. | 439/157 |

*Primary Examiner*—Renee Luebke
*Assistant Examiner*—Michael C. Zarroli
*Attorney, Agent, or Firm*—Sughrue, Mion, Zinn, Macpeak & Seas, PLLC

[57] ABSTRACT

In a lever fitting type connector, a lever is formed by a lever main body including a pair of lever walls, projecting portions which are locked to a hood portion when a connector main body is fitted to the hood portion, and an operating portion provided on the other side of the lever walls to turn the lever walls, taking the locking portion of the projecting portions to the hood portion as a fulcrum. Further, a temporary set fixing unit is provided for fixing the lever walls at a temporary set position to the connector main body in such a manner that the projecting portions are locked to the hood portion at the initial fitting position where the connector main body is inserted in the hood portion.

4 Claims, 7 Drawing Sheets

LEVER FITTING TYPE CONNECTOR WITH TEMPORARY SET POSITION

BACKGROUND OF THE INVENTION

1. Field of the Invention

This invention relates to a lever fitting type connector in which female and male connectors are fitted to each other by operating a lever.

2. Description of the Related Art

FIG. 6 shows a low insertion force connector 1 using an operating lever described in Japanese Patent Unexamined Publication No. Hei. 5-129048. The connector 1 comprises a male connector 3 having a cam pin 2 projected from both side walls 3*a*, 3*a*, a female connector 6 having a pin guide groove 4 for admitting the cam pin 2 provided in both opposite walls 5*a*, 5*a* of a hood 5, and a lever member 7 which has a cam groove 7*d* to be engaged with the cam pin 2 and is rotatably supported on a spindle 6*a* of the female connector 6.

The male connector 3 is provided with a release rib 8 projected on one side wall 3*a* in such a manner as to be extended in the longitudinal direction and with a temporary locking projection 9 projected on the side wall 3*c*. The female connector 6 is provided with a temporary locking notch portion 10 where the temporary locking projection 9 is locked, which is formed on the hood 5, and with a notch portion 11 where the release rib 8 is inserted. Further, a positioning projection 12 is projected adjacent to the notch portion 11. Further, a release inhibiting portion 13 is provided in such a manner as to cover the notch portion 11 and the positioning projection 12. The lever member 7 is formed like a U-shape by connecting the shoulder portions of paired levers 7*a*, 7*a* to each other by a connecting portion 7*b*. The forward end portion of one lever 7*a* is formed to be thin and provided with a projection 7*c*. Cam grooves 7*d*, 7*d* are respectively formed on the levers 7*a*,7*a*.

In the connector 1, as shown in FIG. 7(*a*), the lever member 7 is previously rotatably installed on the hood 5 of the female connector 6, and the forward end portion of one lever 7*a* is brought into contact with the positioning projection 12 to be temporarily stopped. In this condition, as shown in FIG. 7(*b*), when the male connector 3 is inserted in the hood 5, the temporary locking projection 9 engages with the temporary locking notch portion 10 so that the cam pin 2 is inserted in the pin guide groove 4 and the cam groove 7*d*. Further the release rib 8 is brought into contact with the projection 7*c* of one lever 7*a*.

Subsequently, when the male connector 3 is pressurized, the release rib 8 expands the forward end portion of the lever 7*a* outward through the projection 7*c* to be detached from the positioning projection 12, and the cam pin 2 is inserted in the cam groove 7*d* so that the lever member 7 is a little turned to be put in the initial fitting state. Then the male connector 3 can be fitted in the hood 5 by turning the lever 7 in the direction of an arrow P shown in the drawing. In this case, it is possible to decrease the operation force at the time of fitting the male connector 3 and the female connector 6 by the action of levers of the lever member 7.

However, in the above connector, as it is necessary to release the temporary set state of the lever member 7 by pushing the male connector 3 with the male connector 3 inserted in the hood 5, the lever member 7 has the idle running period. Accordingly, a waste is caused in operation of the lever member 7. Further it is necessary to force the male connector 3 inserted in the hood 5 before the lever member 7 is turned to insert the male connector 3 in the hood 5, which causes a problem that fitting work takes much time.

SUMMARY OF THE INVENTION

It is, accordingly, an object of the present invention to provide a lever fitting type connector in which a male connector is initially fitted to a hood portion. The male connector can then be inserted and fitted to the hood portion by operating a lever immediately from the initial fitting state without the idle running period of the lever.

In order to achieve the foregoing object, the invention provides a lever fitting type connector that includes a female connector portion, a male connector and a lever. The female connector portion having a hood portion integrally with a housing portion where a terminal is accommodated. The male connector having a connector main body where a mating terminal to be connected to the terminal is accommodated and which is inserted and fitted in the hood portion to connect the terminal and the mating terminal to each other. The lever for inserting and fitting the connector main body in the hood portion, the lever being formed by a lever main body including a pair of lever walls rotatably supported on both side walls of the connector main body, a projecting portion which is provided on at least one of the lever walls and locked to the hood portion when the connector main body is fitted in the hood portion, and an operating portion which is provided on an opposite end of the projecting portion extends from the lever walls and turns the lever wall, enabling the projecting portion that is locked to the hood portion to act as a fulcrum to fit the connector main body in the hood portion. The male connector and lever includes a temporary set fixing means for fixing the lever walls at a temporary set position to the connector main body in such a manner that the projecting portion is locked to the hood portion at the initial fitting position where the connector main body is inserted in the hood portion.

BRIEF DESCRIPTION OF THE DRAWINGS

FIG. 4(*a*) is a plan view showing the state where a male connector is fitted to a female connector portion; FIG. 4(*b*) is a sectional view showing the inside thereof; and FIG. 4(*c*) is a side view;

FIG. 5(*a*) is a sectional view showing the state where a connector main body is inserted in a hood portion to a temporary set position; and FIG. 5(*b*) is a sectional view showing the state where the connector main body is completely inserted and fitted in the hood portion;

FIG. 7(*a*) is a side view showing the state before fitting; and FIG. 7(*b*) is a side view showing the state after fitting.

DETAILED DESCRIPTION OF THE PREFERRED EMBODIMENT

Figure 1:
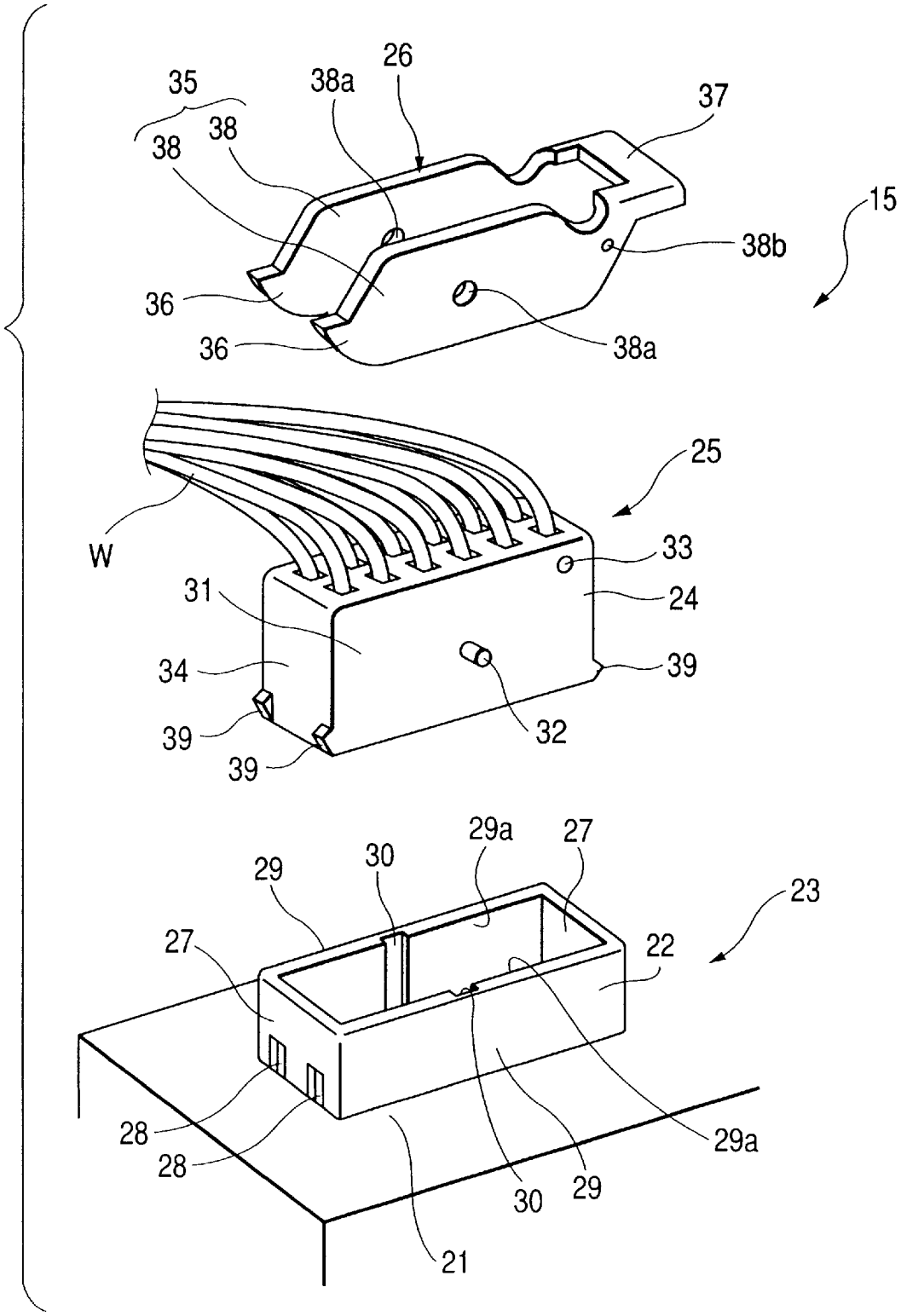
FIG. 1 is an exploded perspective view showing an embodiment of a lever fitting type connector according to the present invention.

The embodiment of the lever fitting type connector according to the present invention will now be described. FIG. 1 is an exploded perspective view showing the lever fitting type connector (hereinafter referred to as "connector").

Figure 2:
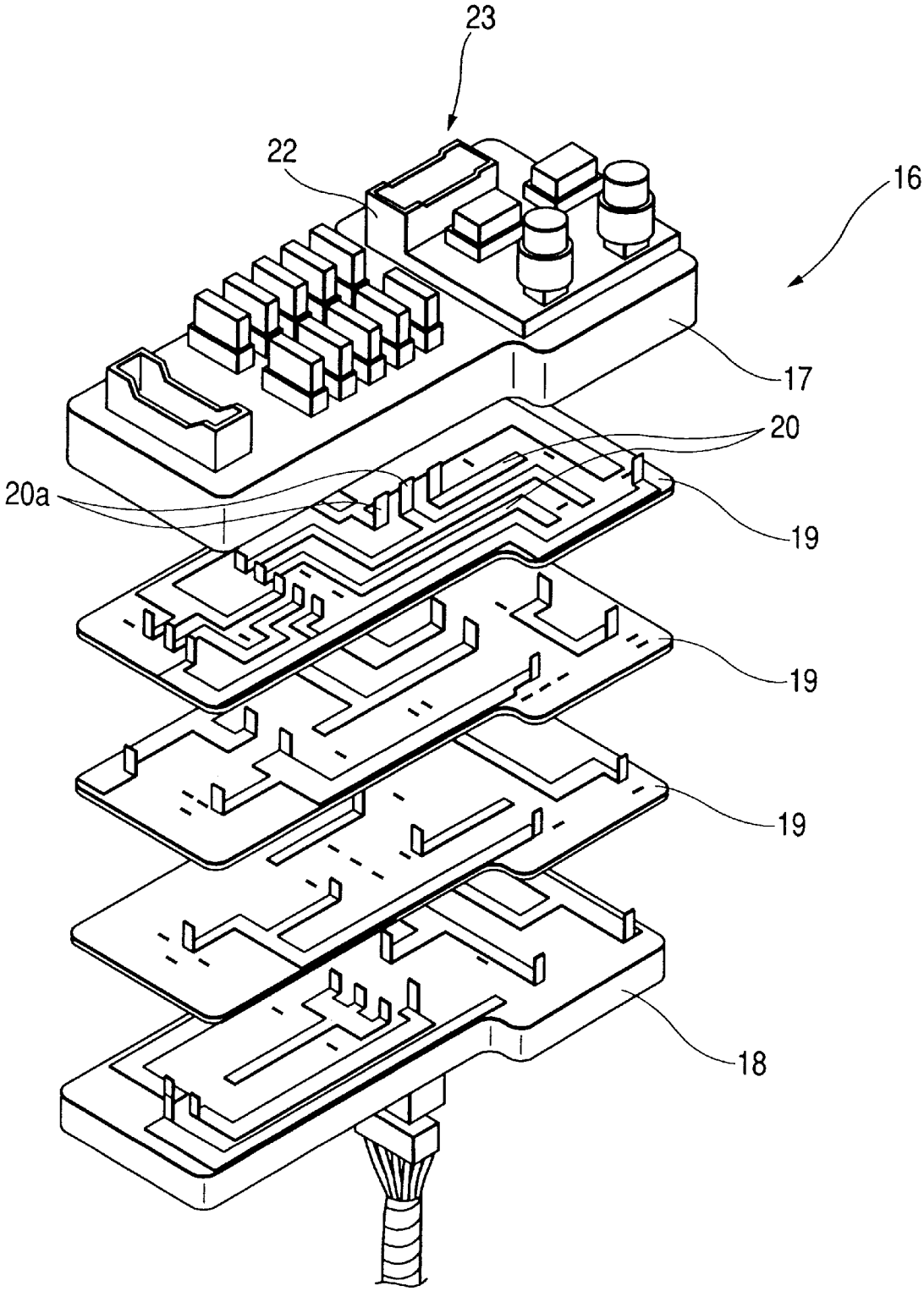
FIG. 2 is an exploded perspective view showing an electric junction box to which the embodiment of the lever fitting type connector is applied.
Figure 3:
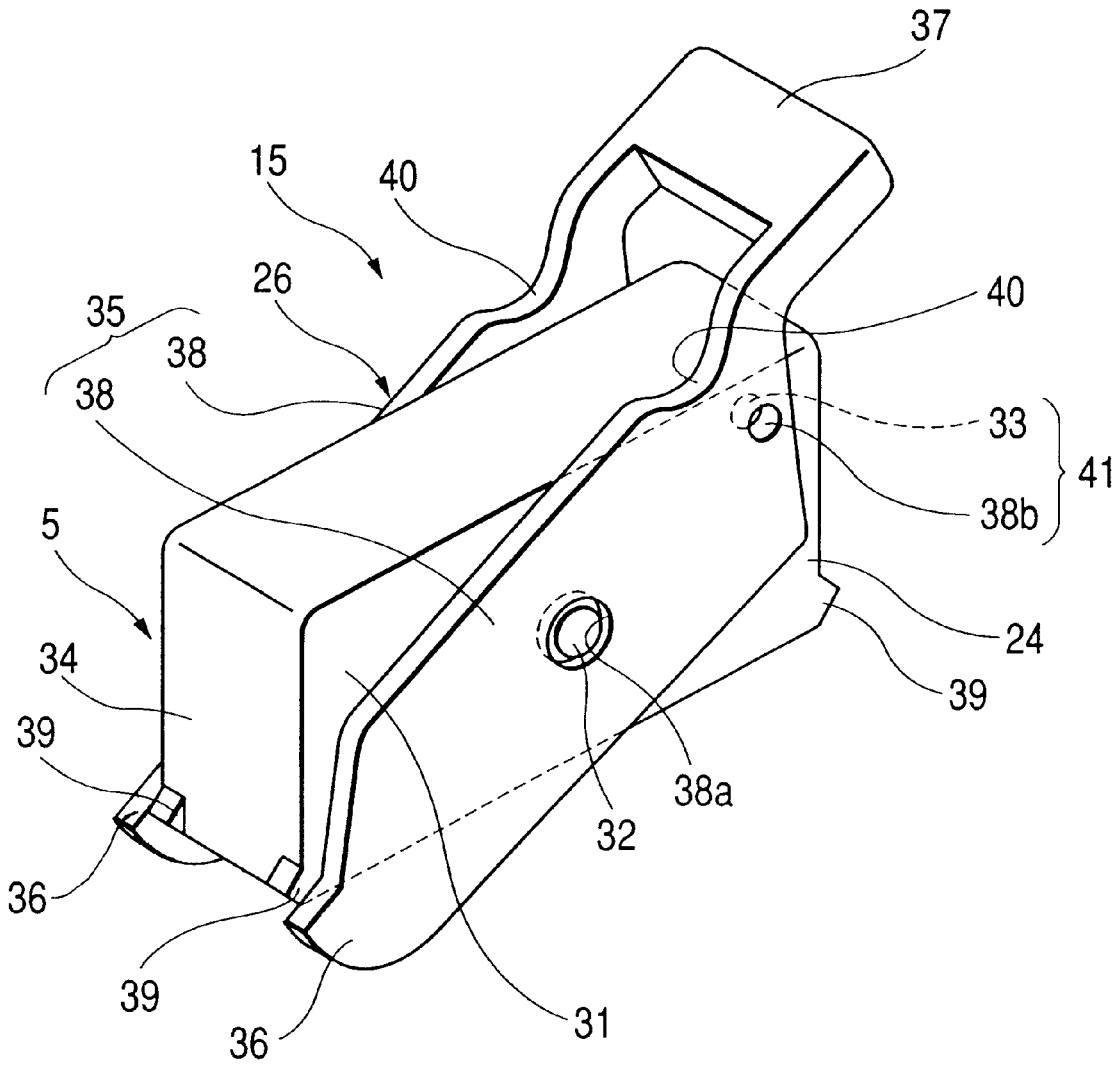
FIG. 3 is a perspective view showing a male connector and a lever externally mounted on the male connector of the embodiment of the lever fitting type connector.

This connector 15 is used in an upper cover 17 of an electric junction box 16 shown in FIG. 2, thereby connecting a bus bar 20 on a wiring board 19 stacked between the upper cover 17 and a lower cover 18 to the terminal portion of a wire harness.

As shown in FIG. 1, the connector 15 comprises a female connector portion 23 where a hood portion 22 is formed integrally with a housing portion 21 of the upper cover 17, a male connector 25 having a connector main body 24 to be inserted and fitted in the hood portion 22 of the female connector portion 23, and a lever 26 externally mounted on the connector main body 24 of the male connector 25 to insert and fit the connector main body 24 in the hood portion 22 of the female connector 23.

The female connector portion 23 is so constructed that the terminal portion of the above bus bar 20 is accommodated in a housing portion 21 and the male terminal portion 20*a* (See FIG. 2) of the terminal portion is projected in the hood portion 22. The hood portion 22 is provided with opposite wall portions 27,27 where notch portions 28, 28 are formed by twos in such a manner as to communicate the inside and the outside of the hood portion 22 with each other. Further, recessed grooves 30, 30 are respectively formed along the fitting direction of the connector main body 24 in the middle portions of the inner walls 29, 29 of the hood portion 22. In the hood portion 22, the connector main body 24 of the male connector 25 is inserted, and a female terminal (not shown) accommodated in the connector main body 24 is brought into conducting contact with the male terminal portion 20*a*.

The male connector 25 is so constructed that a plurality of terminal accommodating chambers are provided in the connector main body 24, and a female terminal is accommodated in each of the terminal accommodating chambers. A mating terminal 20*a* is inserted from one side of the terminal accommodating chamber, and an electric wire W having a female terminal connected to the terminal thereof is drawn out of the other side. A cylindrical boss portion 32 is projected from the central portions of both side walls 31, 31 (only one side is shown in FIG. 1) of the connector main body 24, and a temporary set projection 33 smaller than the boss portion 32 is projected at the upper-right position in FIG. 1 with respect to the boss portion 32. The boss portion 32 is inserted in a rotating hole 38*a* provided in a lever wall 38 which will be described later, and the tip portion projected from the rotating hole 38*a* is inserted in the recessed groove 30 provided in the hood portion 22. The temporary set projection 33 is inserted and locked in a temporary set hole 38*b* provided in the lever wall 38.

Further, the side walls 34, 34 of the connector main body 24 are provided with temporary locking projections 39, 39 projected on both side portions of the fitting surface sides. When the connector main body 24 is inserted in the hood portion 22 (initial fitting time before fitting by the lever 26), these temporary locking projections 39, 39 are respectively inserted and locked in the notch portions 28, 28 of the hood portion 22 to hold the connector main body 24 in the temporary set state to the hood portion 22. The lever 26 is externally mounted on the connector main body 24.

Figure 4A:
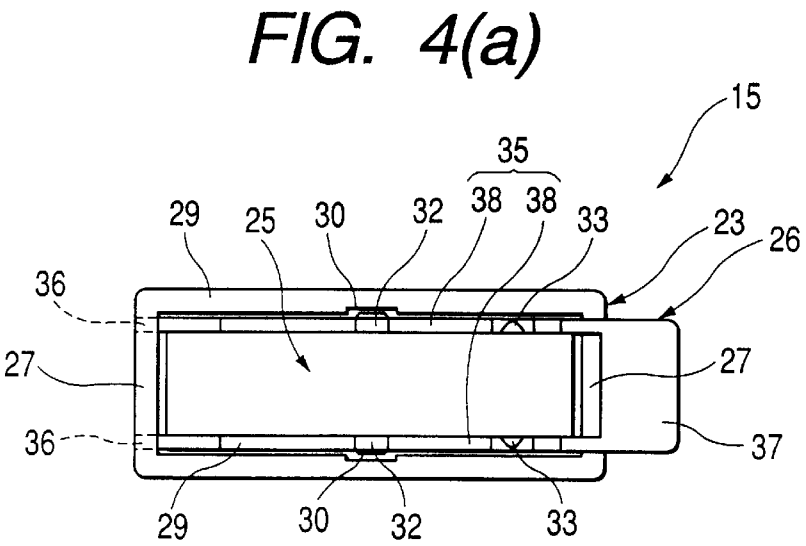
FIGS. 4(*a*) to 4(*c*) show the embodiment of the lever fitting type connector.
Figure 4B:
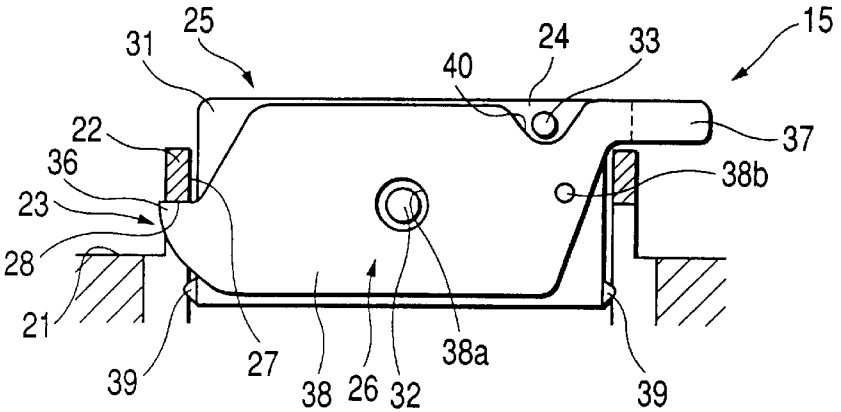
Figure 4C:
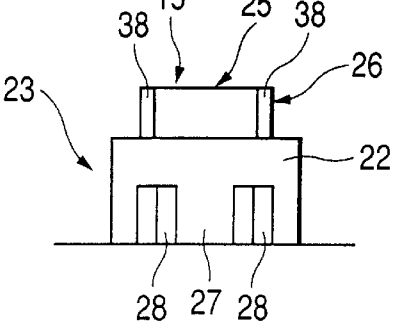

The lever 26 is formed by a lever main body 35 supported on the connector main body 24 of the male connector 25 in such a manner as to freely rotate, a projecting portion provided on one side of the lever main body 35 and locked to the hood portion 22 when the connector main body 24 is fitted to the hood portion 22, and an operating portion 37 provided on the other side thereof and adapted to turn the lever main body 35 centered on the locking portion of the projecting portion 36 to the hood portion 22 to fit the connector main body 24 in the hood portion 22. In the lever 26 of the present embodiment, as shown in FIGS. 4(*a*), 4(*b*), and 4(*c*), with the connector main body 24 fitted to the hood portion 22, the lever main body 35 is positioned inside the hood portion 22.

The lever main body 35 comprises a pair of thin plate-like lever walls 38, 38 respectively supported on both side walls 31, 31 of the connector main body 24 in such a manner as to be freely rotated on the wall surfaces of both side walls 31, 31, the projecting portions 36, 36 are respectively provided on each one side of the lever walls 38, 38, and the operating portion 37 connects the other sides of the paired lever walls 38,38 to each other. The rotating hole 38*a* is formed in the substantially central portion of the lever wall 38. The lever wall 38 is freely rotated on the wall surface of the side wall 31 of the connector main body 24 by inserting the boss portion 32 in the rotating hole 38*a*.

Further, the lever wall 38 is provided with the temporary set hole 38*b* on the operating portion 37 side. The temporary set projecting portion 33 projected from the side wall 31 of the connector main body 24 is inserted and locked in the temporary set hole 38*b* to hold the lever main body 35 in the temporary set position to the connector main body 24. A temporary set fixing means 41 is formed by the temporary set projecting portion 33 and the temporary set hole 38*b*. When the connector main body 24 is initial-fitted in the hood portion 22, with the lever wall 38 locked in the temporary set position to the connector main body 24 by the temporary set fixing means 41, the projecting portion 36 is inserted and locked to the notch portion 28. Accordingly, when the lever 26 is operated from the state of initial-fitting the connector main body 24 in the hood portion 22, the lever wall 38 immediately starts to turn, taking the locking portion where the projecting portion 36 is locked to the notch portion 28 as a fulcrum.

Further, the lever wall 38 is provided with a final locking recessed portion 40 on the operating portion 37 side. The lever walls 38, 38 are, as shown in FIGS. 4(*a*) to 4(*c*), sandwiched between the inner walls 29, 29 in the hood portion 22 and both side walls 31, 31 of the connector main body 24 in the state of completely fitting the connector main body 24 to the hood portion 22.

The next description deals with the procedure of fitting the male connector 25 to the female connector portion 23 in the connector of the present embodiment.

Figure 5A:
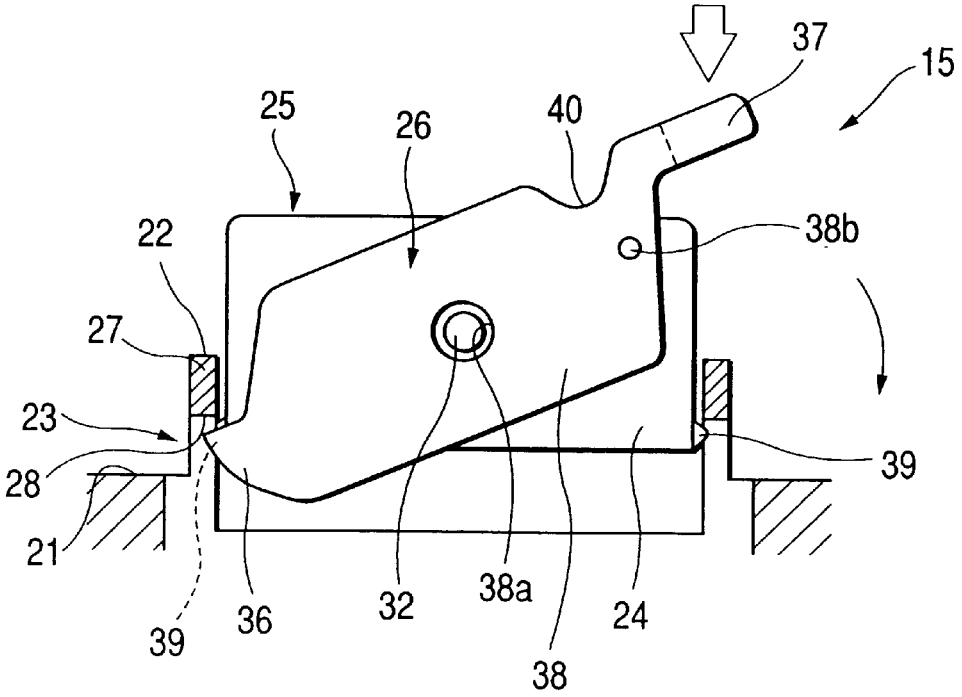
FIGS. 5(*a*) and 5(*b*) show the procedure of fitting the male connector to the female connector portion in the embodiment of the lever fitting type connector.
Figure 5B:
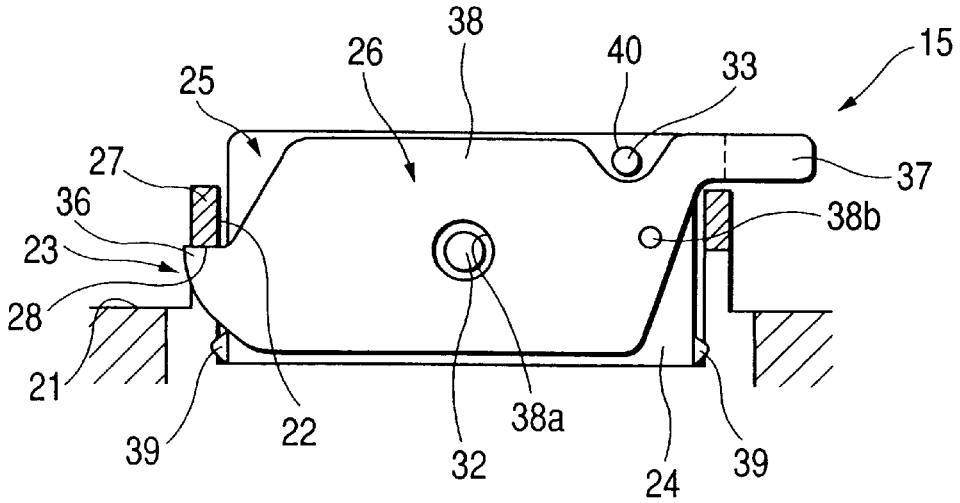
Figure 6:
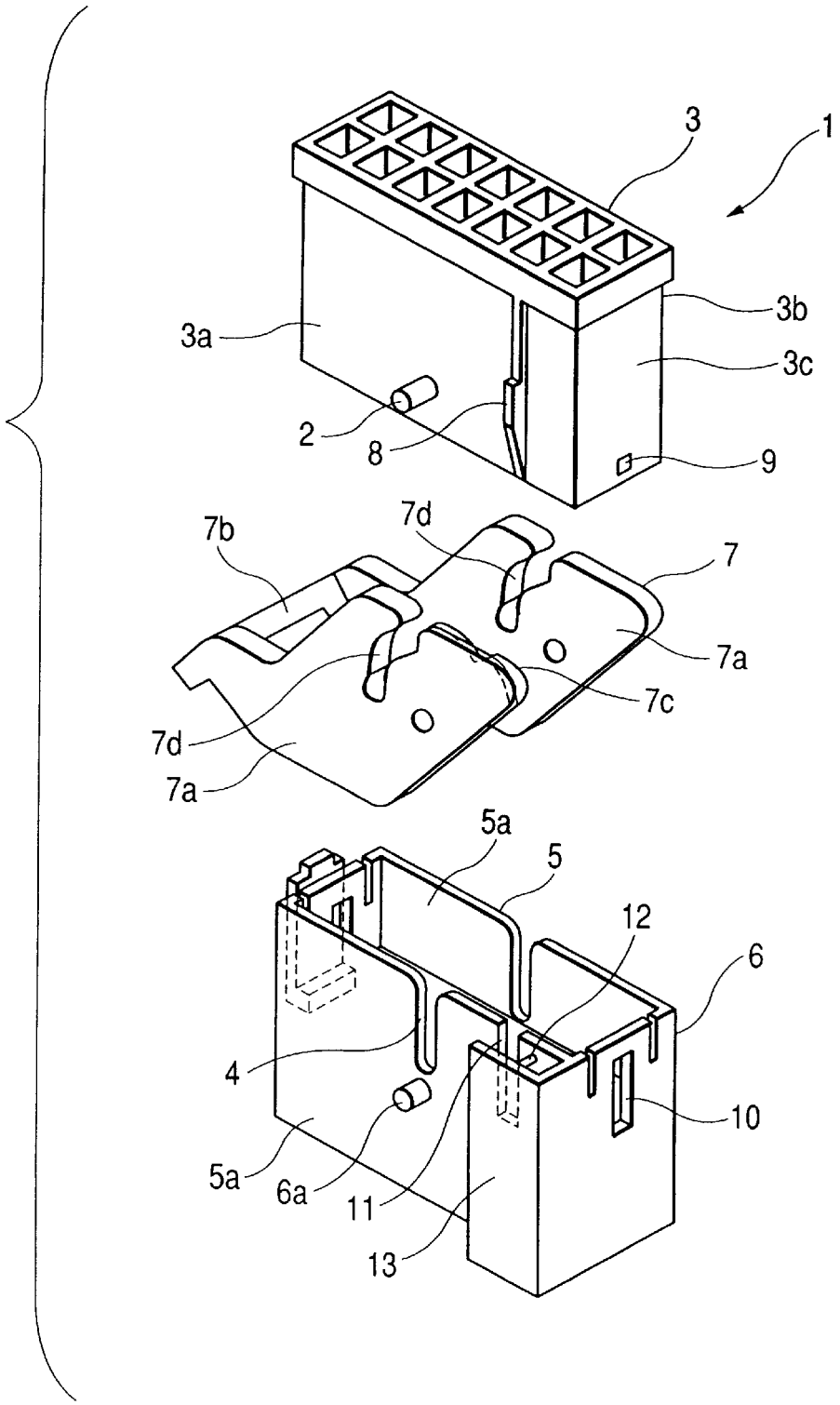
FIG. 6 PRIOR ART
FIG. 6 is an exploded perspective view showing a conventional low insertion force connector using an operating lever.
Figure 7A:
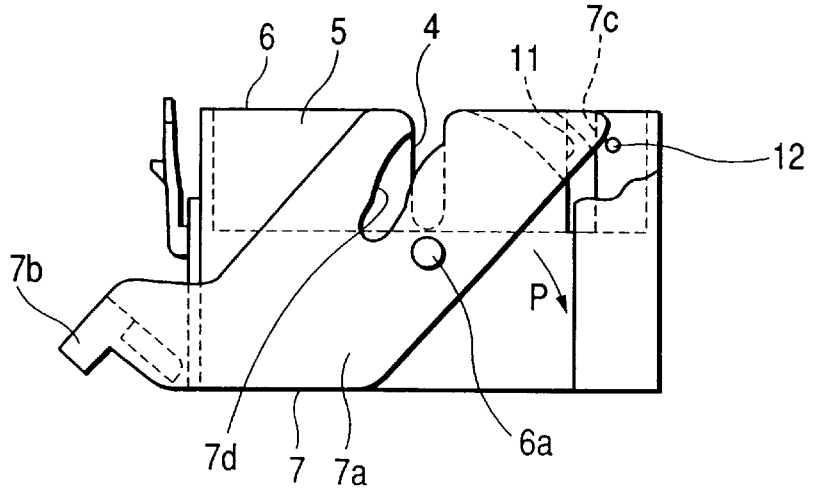
FIG. 7(a) PRIOR ART
FIGS. 7(*a*) and 7(*b*) show the conventional low insertion force connector using the operating lever.
Figure 7B:
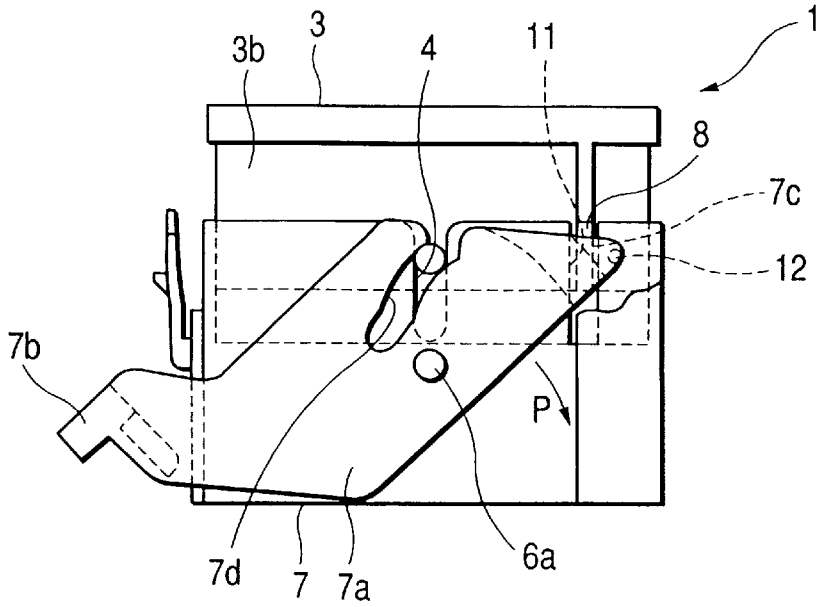
FIG. 7(b) PRIOR ART

From the state of temporarily setting the connector main body 24 at the temporary set position with the temporary set projecting portion 33 inserted and locked in the temporary set hole 38*b*, as shown in FIG. 5(*a*), the connector main body 24 is inserted in the hood portion 22 to be put in the initial fitting state. In such a state, the terminal portion 20*a* of the female connector portion 23 and the terminal of the male connector 25 are not connected to each other. In this case, the connector main body 24 is a little inclined to insert the projecting portion 36 side first in the hood portion 22, and with the projecting portion 36 locked to the notch portion 28, one side is inserted in the hood portion 22.

When the connector main body 24 is inserted in the hood portion 24 to be put in the initial fitting state, the temporary locking projection 39 of the connector main body 24 is locked to the notch portion 28 to hold the connector main body 24 at the initial fitting position of the hood portion 22. Simultaneously the projecting portions 36, 36 on one side of the lever walls 38, 38 are inserted and locked in the notch portions 28.

When the lever 26 is turned by operating the operating portion 37, the lever walls 38, 38 are turned centered on the locking portion of the projecting portion 36 to the notch portion 28. When the lever walls 38, 38 are turned, the connector main body 24 is inserted in the inner portion of the hood portion 22, and as shown in FIG. 5(*b*), finally completely fitted in the hood portion 22.

In this case, if the lever 26 is operated from when the connector main body 24 is put in the initial-fitting state to the hood portion 22, the projecting portion 36 immediately starts to turn, taking the locking portion locked to the notch portion 28 as a fulcrum to insert and fit the connector main body 24 to the inner portion of the hood portion 22. At this time, the lever 26 is turned from the temporary set position to the connector main body 24, and the temporary set projecting portion 33 is detached from the temporary set hole 38*b* to be engaged with the final locking recessed portion 40. The lever walls 38, 38 of the lever 26 are sandwiched between the side wall 31 of the connector main body 24 and a set of the inner walls 29, 29 of the hood portion 22. Further, the lever walls 38, 38 are turned on both side walls 31, 31 of the connector main body 24.

As shown in FIG. 5(*b*), in the case of extracting the connector main body 24 from the hood portion 22 from the state where the connector main body 24 is completely fitted in the hood portion 22, the operating portion 37 is operated in the reverse direction to the above to turn the lever 26 centered on the locking portion of the projecting portion 36 and the notch portion 28. When the lever 26 is turned, the connector main body 24 is extracted from the hood portion 22, and as shown in FIG. 5(*a*), put at the temporary set position, that is, in the state where the temporary set projection 39 is locked to the notch portion 28. In such a state, the lever 26 is positioned at the temporary set position with the temporary set projection 33 inserted and locked in the temporary set hole 38*b*. Then, the male connector 25 can be extracted or disconnected from the female connector portion 23 by pulling up the connector main body 24 from the inside of the hood portion 22.

In the lever fitting type connector 15 of the present embodiment, the projecting portions 36, 36 of the lever walls 38, 38 are thus inserted and locked to the notch portions 28, 28, respectively at the initial fitting position of the connector main body 24 to the hood portion 22, so that when the lever 26 is operated, the projecting portions 36, 36 immediately start to turn, taking the locking portion locked to the notch portions 28, 28 as a fulcrum. Accordingly, there is no idle running period of the lever 26 so that the lever 26 has no wasteful motion, and the connector main body 24 can be inserted and fitted to the inner portion of the hood portion 22 by operating the lever 26 immediately from the initial fitting state.

Furthermore, in the lever fitting type connector 15 of the present embodiment, the temporary set projections 39, 39 provided on the connector main body 24 are locked to the notch portions 28, 28 with the connector main body 24 initial-fitted to the hood portion 22, so that the connector main body 24 is held at the initial fitting position to the hood portion 22. Accordingly, even if the connector 15 is shipped, transported and treated in the state where the connector main body 24 is held at the initial fitting position to the hood portion 22, the connector main body 24 is kept from being carelessly dislocated from the hood portion 22.

Further, in the present embodiment, it is not necessary to force the connector main body in the hood portion to lock the projecting portion 36 to the notch portion 28, so that fitting work does not take much time so as to improve the fitting work efficiency.

Further, in the lever fitting type connector 15 of the present embodiment, as the lever walls 38, 38 of the lever 26 are turned on both side walls 31, 31 of the connector main body 24 and sandwiched between the both side walls 31, 31 of the connector main body 24 and the inner walls 29, 29 of the hood portion 22, even if the lever wall 38 is about to be flexed to the outside, it is regulated by the inner wall 29 of the hood portion 22, so that the lever wall 38 is kept from being detached from the boss portion 32, the connector main body 24 can be surely inserted and fitted in the hood portion 22, and also the operating force for insertion and fitting can be reduced.

Further, the lever fitting type connector 15 of the present embodiment is so constructed that the plate-like lever wall 38 of the lever 26 is sandwiched between both side walls 31 of the connector main body 24 and the inner walls 29 of the hood portion 22, and capable of freely turning on both side walls of the connector main body 24, so that there is little area projecting to the outside of the hood portion 22, and the no whole of the connector is reduced in size so as to decrease the occupying space.

Furthermore, as the notch portions 28, 28 provided on the hood portion 22 communicate the inside and the outside of the hood portion 22 with each other in the present embodiment, it is possible to easily confirm from the outside whether the projecting portions 36, 36 of the lever walls 38, 38 are inserted and locked in the notch portions 28, 28 or not.

Further, in the present embodiment, the temporary set fixing means 41 is provided to temporarily set the lever 26 at the temporary set position to the connector main body 24, whereby at the time of inserting the connector main body 24 in the hood portion 22, the lever 26 is prevented from being unstable not to be an obstacle to work of inserting the connector main body 24 to the hood portion 22.

As described above, according to the present invention, the projecting portion is locked to the hood portion in the initial fitting state where the connector main body is inserted in the hood portion, so that when the lever is operated in such a state, the lever wall immediately starts to turn, taking the locking portion where the projecting portion is locked to the hood portion as a fulcrum not to have the idle running period of the lever wall. Furthermore, it is not necessary to force the connector main body in the hood portion, so that fitting work does not take much time.

What is claimed is:

1. A lever fitting type connector comprising:

a female connector portion having a hood portion integral with a housing portion where a terminal is accommodated;

a male connector having a connector main body where a mating terminal to be connected to the terminal is accommodated and which is inserted and fitted in the hood portion to connect the terminal and the mating terminal to each other;

a lever for inserting and fitting the connector main body in the hood portion, said lever being formed by a lever main body including a pair of lever walls rotatably supported on both side walls of the connector main body, a projecting portion which is provided at an end of at least one of the lever walls and locked to the hood portion when the connector main body is fitted in the hood portion, and an operating portion which is provided at an opposite end of said at least one of the lever walls to facilitate rotation of the lever so that the projecting portion that is locked to the hood portion acts as a fulcrum to fit the connector main body in the hood portion; and temporary set fixing means for fixing the lever walls at a temporary set position to the connector main body in such a manner that the projecting portion is locked to the hood portion at the initial fitting position where the connector main body is inserted in the hood portion, wherein the hood portion is provided with at least one notch portion for communicating the inside and outside of the hood portion with each other, in which the projecting portion is inserted and locked.

2. The lever fitting type connector as claimed in claim 1, wherein said temporary set fixing means includes: a temporary set projecting portion provided on both side walls of the connector main body, and a temporary stop hole which is provided on at least one of the lever walls in which the temporary set projecting portion is inserted and locked.

3. The lever fitting type connector as claimed in claim 2, wherein when force is applied to said operating portion said lever moves from said temporary set position to a final position, at which said temporary set projecting portion is disengaged from said temporary set hole and engaged with a final locking portion of said lever to retain said lever in said final position.

4. A lever fitting type connector comprising:

a female connector portion having a hood portion integral with a housing portion where a terminal is accommodated;

a male connector having a connector main body where a mating terminal to be connected to the terminal is accommodated and which is inserted and fitted in the hood portion to connect the terminal and the mating terminal to each other;

a lever for inserting and fitting the connector main body in the hood portion, said lever being formed by a lever main body including a pair of lever walls rotatably supported on both side walls of the connector main body, a projecting portion which is provided at an end of at least one of the lever walls and locked to the hood portion when the connector main body is fitted in the hood portion, and an operating portion which is provided at an opposite end of said at least one of the lever walls to facilitate rotation of the lever so that the projecting portion that is locked to the hood portion acts as a fulcrum to fit the connector main body in the hood portion; and temporary set fixing means for fixing the lever walls at a temporary set position to the connector main body in such a manner that the projecting portion is locked to the hood portion at the initial fitting position where the connector main body is inserted in the hood portion, wherein at the initial fitting position where the connector main body is inserted in the hood portion, with the lever walls fixed to the temporary set position, a temporary locking projection locked to the hood portion is projected with the projecting portion from the connector main body.

* * * * *